United States Patent [19]

Edelmann

[11] Patent Number: 4,520,730

[45] Date of Patent: Jun. 4, 1985

[54] PRESETTING PROCESS FOR PRINTING CYLINDRICAL OR CONICAL ARTICLES

[75] Inventor: Gilbert Edelmann, Lausanne, Switzerland

[73] Assignee: Cebal, Clichy, France

[21] Appl. No.: 440,549

[22] Filed: Nov. 10, 1982

[30] Foreign Application Priority Data

Dec. 8, 1981 [CH] Switzerland ..... 7831/81

[51] Int. Cl.[3] ..... B41C 1/00

[52] U.S. Cl. ..... 101/426; 101/211; 101/401.1; 101/DIG. 12; 101/35; 33/184.5

[58] Field of Search ..... 101/DIG. 12, 401.1, 101/211, 426, 35; 33/184.5

[56] References Cited

U.S. PATENT DOCUMENTS

| | | | |
|---|---|---|---|
| 1,151,461 | 8/1915 | Hatt | 101/DIG. 12 |
| 2,236,000 | 3/1941 | Koessler et al. | 101/DIG. 12 |
| 2,580,576 | 1/1952 | Myers, Jr. . | |
| 2,630,755 | 3/1953 | Herrin | 101/DIG. 12 |
| 2,711,031 | 6/1955 | Kessler, Jr. | 101/DIG. 12 |
| 2,793,442 | 5/1957 | Ozga | 101/DIG. 12 |
| 3,908,546 | 9/1975 | Porter . | |
| 4,033,259 | 7/1977 | Schuhmann . | |

FOREIGN PATENT DOCUMENTS

| | | |
|---|---|---|
| 2045953 | 3/1972 | Fed. Rep. of Germany . |
| 3025060 | 7/1979 | Fed. Rep. of Germany . |
| 2312373 | 12/1976 | France . |
| 871664 | 6/1961 | United Kingdom . |
| 1575016 | 9/1980 | United Kingdom . |

*Primary Examiner*—Clifford D. Crowder

*Attorney, Agent, or Firm*—Oblon, Fisher, Spivak, McClelland & Maier

[57] ABSTRACT

A process for presetting a dry offset printing machine intended for printing cylindrical or conical workpieces, in which presetting templates are prepared from a matrix film which is also used for producing the working blocks and perform the function of permanently setting the machine so that the subsequent introduction of blocks merely requires simple checking.

6 Claims, 10 Drawing Figures

PRESETTING PROCESS FOR PRINTING CYLINDRICAL OR CONICAL ARTICLES

This invention relates to a process for presetting a dry offset machine intended for printing cylindrical or conical workpieces.

Various types of products are accommodated in cylindrical or conical containers. Thus, in the cosmetics field for example, aerosol tubes and pots are widely used. Tubes of glue, pots of yoghourt and spray paints are further examples. The decoration or information appearing on containers of the type in question is applied by means of dry offset printing machines. Dry offset printing machines are relatively expensive so that it is advisable to use them almost continuously to make them pay. This is even more imperative in cases where printing is carried out by a machine integrated into a complete production line in which the workpieces are produced, printed, dried, finish-machined and, in some cases, even filled and wrapped. In production lines such as these, any stoppage represents a considerable loss. Now, the line does in fact have to be stopped to change the blocks for starting a new series of workpieces with different patterns. In view of the cost of stopping the machine, the time spent on introducing and adjusting a new set of printing plates, or "working blocks" has to be reduced to a minimum. This preoccupation is also encountered in other fields where printing is involved and has produced many attempts to find a solution. Accordingly, various solutions have been proposed, particularly in patent specifications. The majority of these solutions are based on the same principle, namely combining the operation by which the block is fixed or fastened to the block support quadrant with the operation by which the blocks are adjusted relative to one another. In general, this principle is applied in practice by the formation in the block of perforations in which fastening hooks locked to the quadrant engage and then brace and position the block on the quadrant. Numerous versions of this type of solution are disclosed in particular in the following patent specifications: Swiss Pat. Nos. 492,557 and 551,241 DE-OS Nos. 25 01 266, 29 44 675 and 30 25 060, DE-AS No. 20 45 953, German Pat. No. 2,010,899, British Pat. No. 1,575,016 and U.S. Pat. No. 3,908,546.

The main feature of the known solutions is that the precision with which the machine is set up is dependent upon the precision with which the perforations were formed and upon the exact adaptation of the hooks to the shape of the perforations. This precision is limited by the necessary characteristics of the material used for making the blocks and by the difficulty of making hooks which are mobile without at the same time having any clearance. Systems of this type are not used in practice because they are not entirely satisfactory. Accordingly, the blocks are mostly adjusted in the machine by trial and error. The time taken to complete the operation thus depends upon the skill or luck of the machine operator. For a four-colour machine having therefore four quadrants on which four blocks are mounted, the set-up time is of the order of two hours. It is the object of the present invention to reduce this set-up time to approximately fifteen minutes.

The solution provided by the invention is defined in the claims.

The process according to the invention is described in more detail in the following with reference to the accompanying drawings, wherein.

Figure 4A:
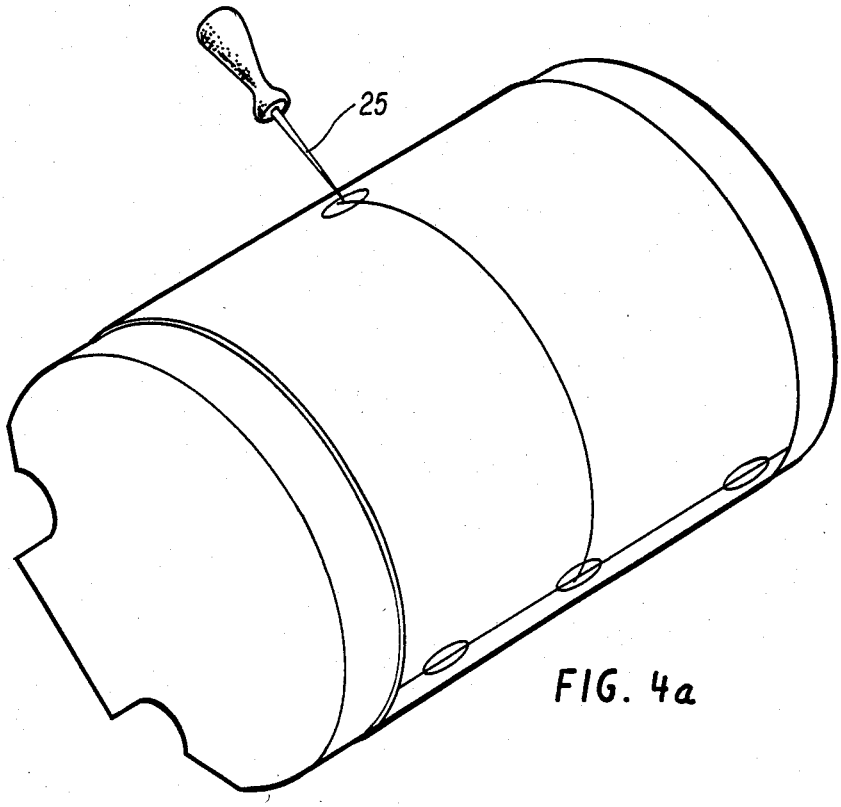

FIG. 4*a* is a view of the marking of a sector.

Figure 4B:
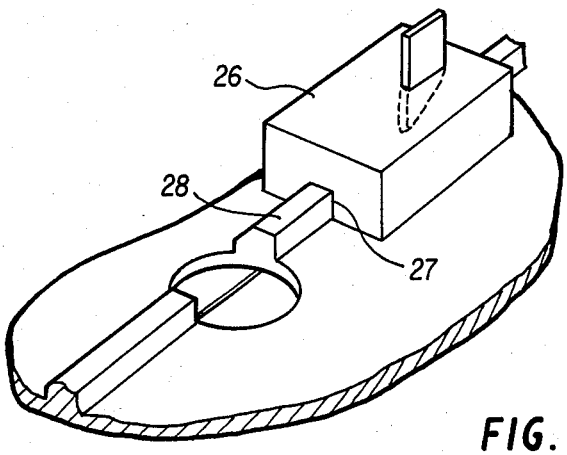

FIG. 4*b* is a view of the marking guide.

Figure 5:
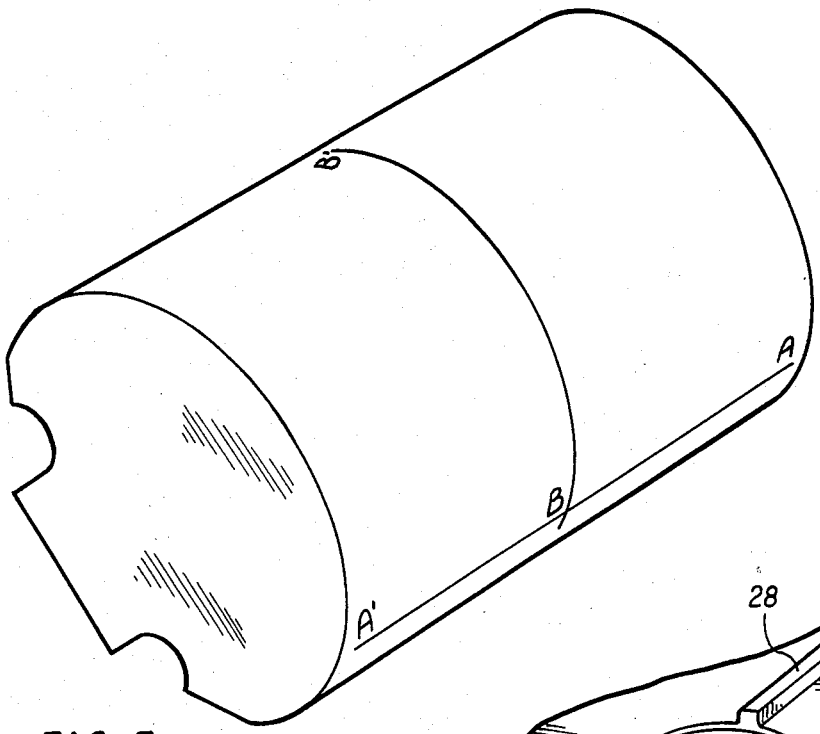

FIG. 5 is a view of a quadrant on which axes have been drawn.

Figure 6B:
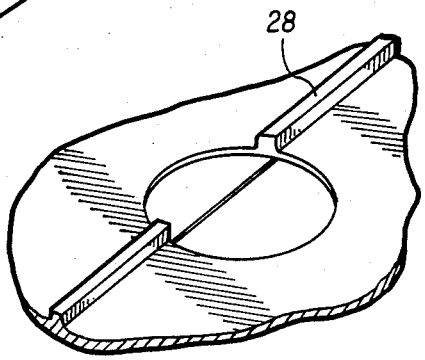
Figure 6A:
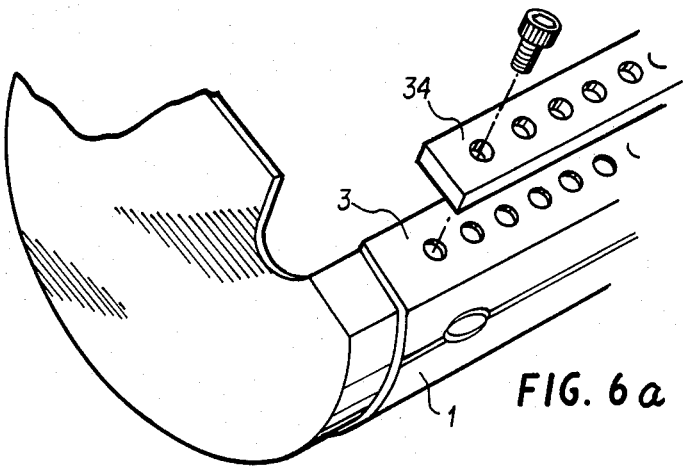

FIG. 6*a* is a view of a working block (or template) during positioning on a quadrant.

FIG. 6*b* shows the appearance through a perforation of the axis drawn on a quadrant.

Figure 7:
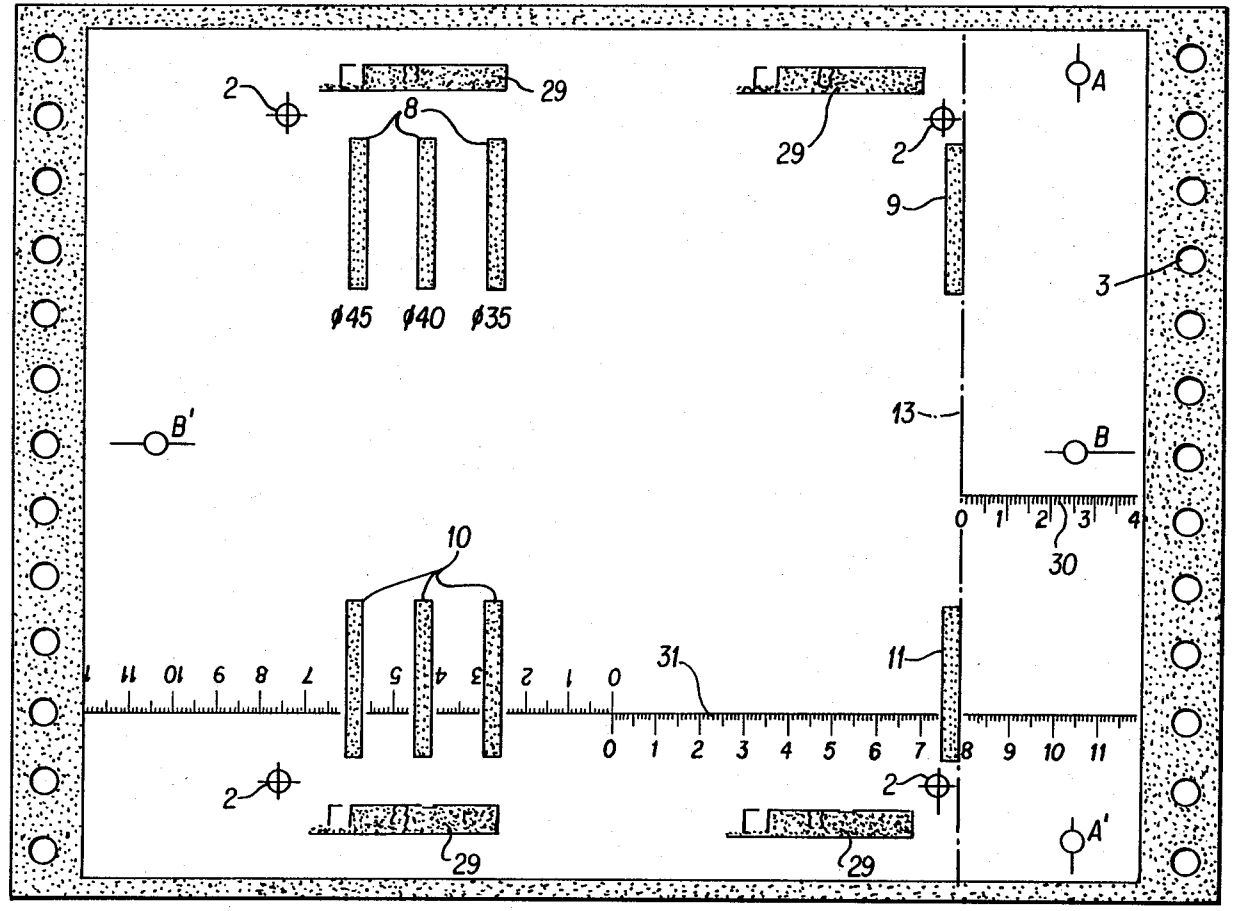

FIG. 7 shows a detailed variant of the master template.

Figure 8:
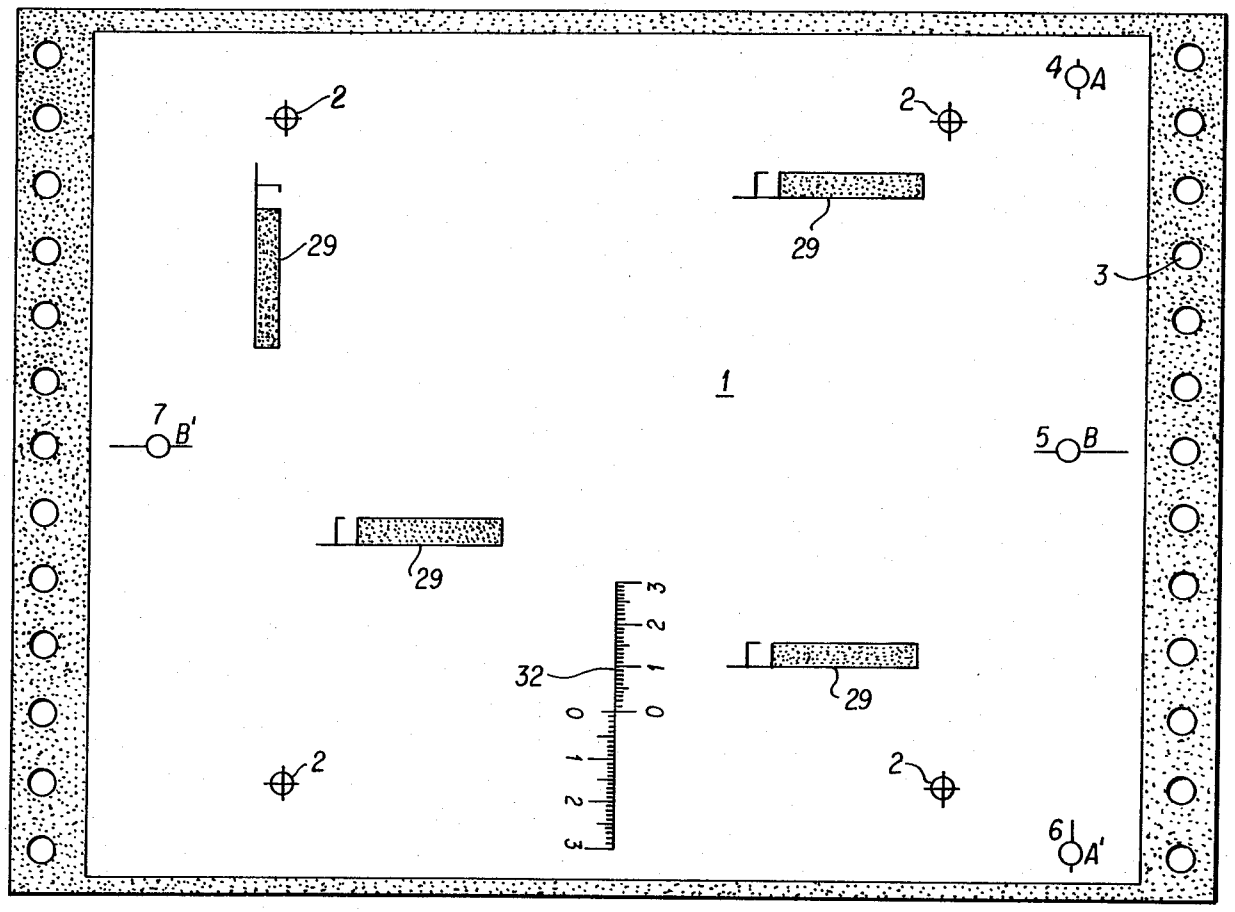

FIG. 8 shows a detailed variant of a template.

Figure 3:
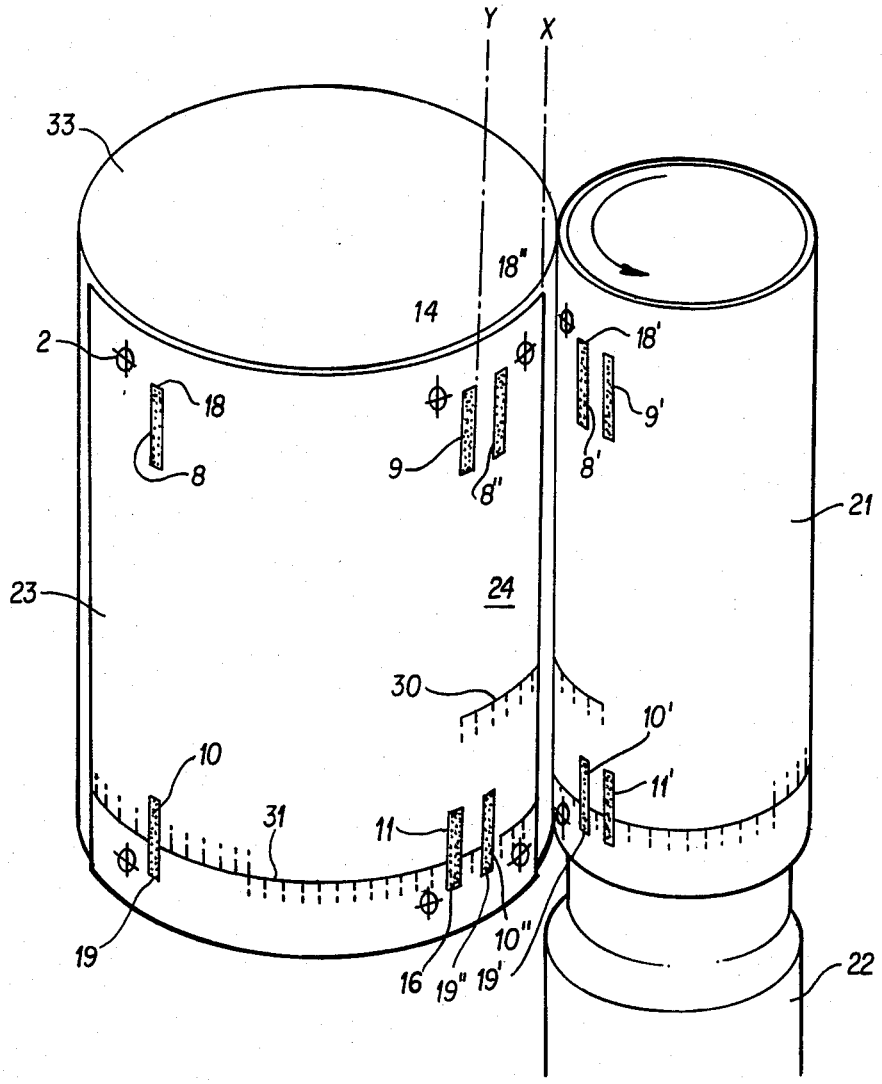
FIG. 3 is a view of a blanket support quadrant and a test specimen.

FIG. 3 does not show the image printed on the blanket as it appears in practice because, since the templates are positively engraved, they are "readable" with the result that the blanket is "unreadable" as the image is inverted. In the drawing, this inversion has been intentionally ignored so that the reader encounters the various elements in the same arrangement in all the Figures.

Figure 1:
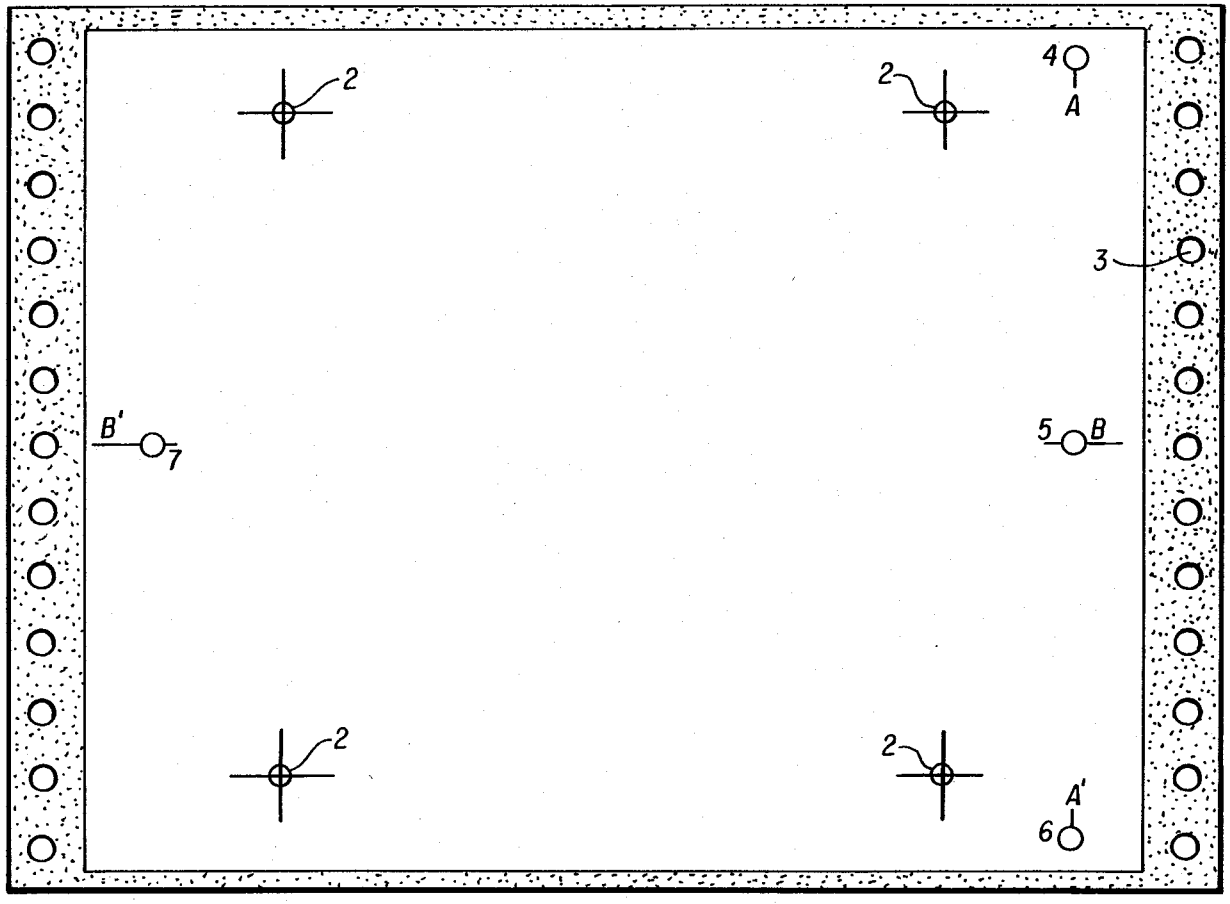
FIG. 1 shows a presetting template.

As shown in FIG. 1, the presetting template is a thin block identical with the blocks commonly used for dry offset printing. The template 1 is made by the same process as a working block. The various elements which appear on the template in the Figures are first applied to a litho-orthochromatic film which allows them to be copied onto photopolymeric plates, the plates then being immersed in a washing bath to create the relief.

In the following description, the various engraved elements involved in the invention are described as they appear on the finished block. The operations involved in producing the film and subsequently engraving the plates are together a technique well known among experts and will not be described here.

Figure 2:
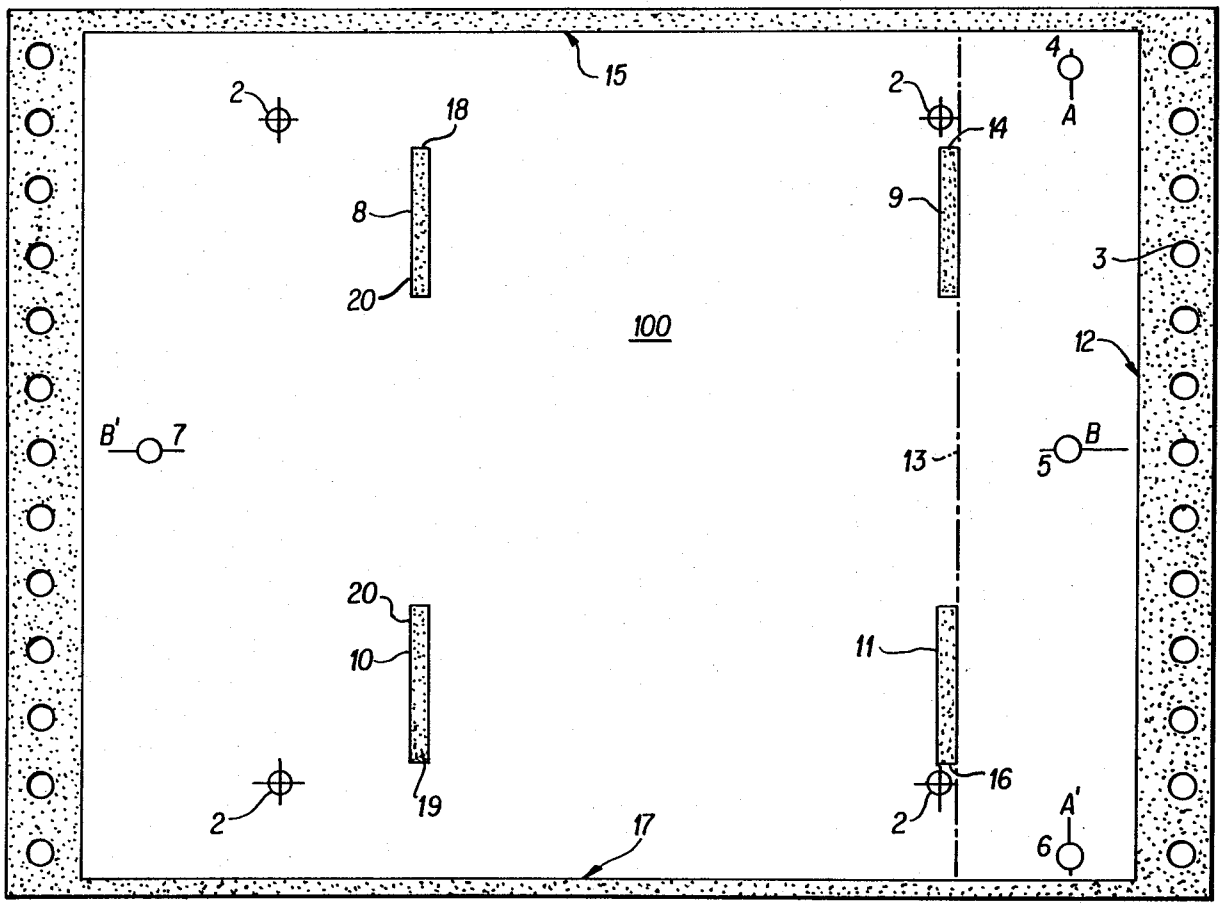
FIG. 2 shows the master template.

Reference crosses 2 of the type commonly encountered in photogravure are disposed on a film. Two axes AA' and BB' are added. The axis AA' is disposed parallel to the axis of rotation of the block support quadrant to which the template will be fixed in a subsequent step. The axis AA' is situated close to the right-hand fastening margin 3 of the template. Its positioning more or less close to said margin is unimportant. The second axis BB' is then disposed perpendicularly to the axis AA' in the variant illustrated. However, the direction of the axis BB' is not necessarily perpendicular to the axis AA', although it is preferable for the two axes to form an angle of from 80° to 100° with one another. The film bearing the reference crosses 2 and the axes AA' and BB' forms a base matrix. Four alignment bars 8,9,10 and 11 are then disposed on a copy of said matrix (FIG. 2) which serves as an enriched matrix film. The four alignment bars 8, 9, 10 and 11 are strictly parallel to the axis AA' and hence to the axis of rotation of the block support quadrant. In the variant illustrated, these bars are 5 mm wide and 35 mm long. The two right-hand bars 9 and 11 are positioned at a distance from the right-hand edge 12 of the block which varies according to the machine in which the blocks will have to operate. For a machine of the WIFAG type, the distance separating the right-hand edge 12 of the block from the right-hand edge 13 of the bars 9 and 11 is set at 40 mm. The tip 14 of the bar 9 is situated 25 mm from the top of the block 15. The base 16 of the bar 11 is situated 25 mm from the bottom of the block 17. The two left-hand bars 8 and 10 have the same dimensions as the two right-hand bars. Their positioning on the block takes two factors into account. Firstly, their position is determined by two lines perpendicular to the axis AA'. One of them is taken through the tip 14 of the upper right-hand bar 9. The tip 18 of the bar 8 is aligned on that perpendicular line. Similarly, the bottom 16 of the bar 11 and the bottom 19 of the bar 10 are aligned on the same perpendicular to the axis AA'. Secondly, the distance separating the right-hand side 13 of the two right-hand bars 9 and 11 from the left-hand side 20 of the two left-hand bars 8 and 10 is determined by the development of the workpieces on which printing will finally take place. The usual diameters of the workpieces which are printed by means of blocks having the format illustrated are 35, 40 and 45 mm. Accordingly, the developments of these workpieces are 109.2 mm, 124.8 mm and 140.4 mm, respectively. In the variant illustrated in FIG. 2, the distance is 124.8 mm and thus corresponds to a workpiece 40 mm in diameter. It is also intended to show the bars corresponding to several developments on the same template (FIG. 7). The number of templates which have to be engraved will depend upon the number of colour groups which the machine comprises. For a four colour dry offset press, four templates are made. The first of these four templates, the master template 100 which corresponds to the first quadrant, comprises all the elements described hitherto, namely the reference crosses 2, the positioning axes AA' and BB' and the aligment bars 8,9,10 and 11 (FIG. 2). The other three templates are identical with one another but only comprise the crosses 2 and the axes AA' and BB' (FIG. 1). After the four templates have been made up, four perforations are formed in each of them. The four perforations are positioned in the same way and in the same places on each template. Centred on the axis AA', two perforations 4 and 6 from 5 to 10 mm in diameter are formed. One of the perforations 4 is formed in the top of the block and the other 6 in the bottom. These perforations are circular in the drawing, although other forms, more particularly oblong, square or triangular, may also be envisaged. Another two perforations are then formed on the axis BB', one 5 on the right of the template centred both on the axis BB' and the axis AA'. This perforation is also provided on one side of the axis AA', although the variant illustrated in FIGS. 1 and 2 provides accordingly for the presence of a third reference 5 in addition to the two perforations 4 and 6 of the axis AA' which have already been described. A second perforation 7 is formed on the axis BB', but on this occasion on the left of the template. The four templates are then bent to a curvature scarcely more open than that of the quadrants on which the templates are to be mounted. After the templates have been perforated and curved, they are mounted in the machine. The machine may then be preset. Presetting begins with the positioning of the master template on the first colour group of the machine. The master template 100 is the template which has the aligment bars 8,9,10 and 11 in addition to the crosses 2 and the axes AA' and BB'. The master template is fixed to the quadrant corresponding to the first group. A test specimen 21 is then fitted to the specimen holder in the form of a mandrel 22 (FIG. 3). After inking-up of the template, a pass is made with the blanket 23. The ink is transferred from the template to the blanket 23 and then from the blanket to the test specimen 21. At this stage, the end of the blanket 23 is still not adjusted and an additional part 24 overlaps. As a result, the blanket 23 is in contact with the test specimen 21 over a greater developed length than the development of the test specimen. Accordingly, the ink which the blanket 23 has deposited onto the test specimen 21 is redeposited—after the test specimen has completed a revolution—onto the additional part 24 of the blanket.

As shown in FIG. 3, the first images deposited by the blanket are the bars 8 and 10 which are printed 8' and 10' on the specimen 21 and then redeposited onto the blanket 8'' and 10''. The tip 18'' of the bar 8'' is then checked for alignment level with the tip 14 of the bar 9 which marks the end of the blanket. The base 19'' of the bar 10'' is also checked for alignment with the base 16 of the bar 11. If the tips 18'' and 14 and the bases 19'' and 16 are not in alignment, the master template 100 is adjusted on the quadrant by the play of the fixing bars 34 (FIG. 6*a*) until said alignment is obtained. When alignment is obtained, the axis AA' and the alignment bars 8,9,10 and 11 are demonstrahly oriented parallel to the axis of rotation of the quadrant.

The space separating the bars 14 and 18'' and the bars 16 and 19'' emanates from the fact that the number $\pi$ has a conventionally different value in the field of the impression, the conventional value being 3.12. Depending on whether the offset machine rotates clockwise (WIFAG type) (FIG. 3) or anticlockwise, the end of the blanket will be situated on the right or on the left. In this case, all the positions of the above elements are merely inverted.

With the master template 100 correctly positioned on the first quadrant, the quadrant is marked (FIG. 4*a*) by means of a stylet which draws two reference marks aligned on the axis AA' through the perforations 4 and 6 and another two reference mark aligned on the axis BB' through the perforations 5 and 7.

Marking is carried out using either a simple stylet 25 (FIG. 4*a*) or a stylet mounted on a guide 26 (FIG. 4*b*). In the latter case, the guide comprises a groove 27 which follows the relief of the axis 28 and guides the stylet by sliding along the rail formed by the relief of the axis.

In order to adjust the group corresponding to the second colour, one of the three identical templates shown in FIG. 1 is placed on the second quadrant. A pass is then made over the blanket, but on this occasion without a test specimen. The master template 100, which is mounted on the first quadrant, deposits its motifs, particularly the reference crosses 2, onto the blanket in the same way as shown in FIG. 3. The second template 1 in turn deposits its motifs as shown in FIG. 1 onto the blanket. The second template is then adjusted on the second quadrant until its reference crosses 2 coincide exactly on the blanket with the crosses 2 left by the master template 100. When the coincidence of the crosses is perfect, the second quadrant is marked out in the same way as the first.

The operation described above is repeated for the third and then for the fourth sector. The reference crosses corresponding to the four groups are thus perfectly superposed and the four quadrants are marked out.

The four templates are then removed from the machine and the axes AA' and BB' are drawn (FIG. 5) on each of the sectors by connecting the reference marks which were marked through the perforations 4,5,6 and 7, as described above. Each of the quadrants now bears the two axes AA′ and BB′, as shown in FIG. 5.

In a more detailed variant (FIGS. 7 and 8), the templates receive, in addition to the elements already described, gauges 29 which enable the pressure on the blanket as well as the doubling and the millimetric scales 30, 31 and 32 to be checked. The gauges 29 are differently disposed on each of the four templates so that the gauges of each template leave a distinct impression on the blanket.

The millimetric scales each have their own function. The scales 30 and 31 are disposed on the master template (FIG. 7). The origin of the scale 30 is located on the end-of-blanket line which is determined by the right-hand edge 13 of the alignment bars 9 and 11. As mentioned earlier on, the blanket is longer than the development of the test specimen. The scale 30 is printed from the master template onto the additional part 24 of the blanket (FIG. 3). Reading of the transferred scale 30 gives an exact indication of the length of the additional part 24 to be eliminated. This indication makes it possible to adjust the blanket support quadrant 33 in such a way that the actual end X of the blanket coincides with the ideal end Y determined by the right-hand edge 13 of the alignment bars 9 and 11. The second millimetric scale 31 (FIG. 7) is positioned perpendicularly to the axis AA′. Its origin is situated in the central part of the master template, the exact position being unimportant. However, once it has been selected, it will be transferred exactly to the other three templates 1 (FIG. 8). The scale 31 is double in the sense that the graduation develops to the right and the left from the origin.

A millimetric scale 32 is disposed on the other three templates 1 (FIG. 8). Its centre is the transferred origin of the scale 31 whilst its axis is parallel to the axis AA′.

The scale 31 extends over the entire length of the master template because it often happens that the quadrants of a machine are completely out of phase synchronism. In that case, the scale 32 printed by the second template for example may be situated both on the extreme left and on the extreme right of the impression left on the blanket by the master template. The degree of corrective action to be taken may be read directly at the point of intersection between the scale 31 and the scale 32. The correction in the development, i.e. the synchronisation of the quadrants, is read on the scale 31, the correction affecting the vertical position of the template on the quadrant being read on the scale 32. The assembly formed by the scales 31 of the master template and 32 of each of the other three templates has the same function as the reference crosses 2 but is used when the magnitude of the corrections is greater.

When the machine has been preset, i.e. when the axes AA′ and BB′ have been drawn on the four quadrants, the machine is ready to receive the working blocks and to begin printing the workpieces in batches.

All the working blocks are made on the basis of copies of the matrix film. As a result, the axes AA′ and BB′ appear on all the blocks. They are only materialised by the engraving in the vicinity of the perforations 4,5,6 and 7 (FIGS. 6*a* and 6*b*).

The sets of blocks continue to be set up in the machine to enable the operator to check the coincidence of the axes AA′ and BB′ drawn on the quadrant with the axes AA′ and BB′ drawn on the block (FIG. 6*b*). It is sufficient for the operator to adjust the block through the play of the fixing bars 34 (FIG. 6*a*) by bringing their axes into superposition.

Bringing into coincidence and checking are made possible by the fact that the perforations 4,5,6 and 7 formed in each of the blocks enable the axes drawn on the quadrants (FIG. 6*b*) to be seen.

The presetting of the machine enables different block formats to be used because, with the axis AA′ being situated close to the fastening margin 3, irrespective of the size of the block, it is possible to form two perforations through which the axis AA′ can be seen. So far as the axis BB′ is concerned, it will be situated at mid-height if the block is large and at the top of the block if the block is smaller.

The advantage which the present invention has over already known solutions lies in the postponement to a certain extent of the adjustment time or, more exactly, in the division of adjustment into two separate steps. The first step is the presetting of the machine which takes slightly longer than normal adjustment, but has the advantage of being permanent, i.e. does not have to be repeated. The second step, which is largely dependent on the first, comprises postponing the moment of adjustment of the block on the quadrant or, more precisely, presetting it in such a way that adjustment in the machine is confined to a simple check, thus eliminating the trial and error approach which excessively immobilises the machine.

Already known systems also seek to postpone the moment of adjustment but, apart from their unreliable operation, they have the disadvantage of requiring total precision for an operation (perforation of the blocks) which lends itself least to total precision. By contrast, the present invention requires the same precision for an operation which lends itself perfectly to precision (copying of the matrix film) whereas the perforations used are formed with relative precision without any disadvantages arising.

I claim:

1. A process for presetting a dry offset printing machine intended for printing cylindrical or conical workpieces and for setting corresponding working blocks, said process comprising the steps of:

(a) preparing a base matrix film by disposing on a film a plurality of spaced reference crosses and two axes forming an angle of from 80° to 100° with one another;

(b) making an enriched matrix film by disposing a plurality of alignment bars on a copy of the base matrix film;

(c) making a master template from the enriched matrix film;

(d) making a plurality of secondary templates which are identical with one another and with the base matrix film;

(e) making four perforations on the master template and on each of the plurality of secondary templates, corresponding perforations on each of the templates being located in corresponding places on each of the templates, two of the perforations being located on one of the two axes mentioned in step (a) and the other two of the perforations being located on the other of the two axes mentioned in step (a);

(f) making working blocks from copies of the base matrix film by forming four perforations therein corresponding to the four perforations mentioned in step (e) on each copy and engraving thereon axes corresponding to the axes mentioned in step (a);

(g) placing the master template on the first quadrant of a dry offset printing machine and inking it up;

(h) making a pass with a blanket and a test specimen, thereby printing images of the reference crosses and the alignment bars on the test specimen and redepositing images of the reference crosses and the alignment bars on the blanket;

(i) adjusting the positions of the master template by checking the positons of the images of the alignment bars on the test specimen and the blanket;

(j) placing the secondary templates on subsequent quadrants of the dry offset printing machine and inking them up;

(k) making a pass over the blanket and the test specimen, thereby printing images of the reference crosses mentioned in step (a) on the test specimen and redepositing images of the reference crosses on the blanket;

(l) adjusting the positions of the secondary templates to ensure that the images of the reference crosses on the blanket coincide with the images of the reference crosses on the master template;

(m) marking each quadrant of the dry offset printing machine through the perforations with reference marks aligned with the axes mentioned in step (a);

(n) removing the templates from the dry offset printing machine;

(o) drawing axes corresponding to the axes mentioned in step (a) on each quadrant on the dry offset printing machine by connecting the reference marks mentioned in step (m); and (p) placing each working block in position by superposing the axes engraved on each working block on the corresponding axes marked on the corresponding quadrant of the dry offset printing machine.

2. A process as recited in claim 1 wherein:

(a) one of the axes mentioned in step (a) is parallel to the axis of rotation of the dry offset printing machine and (b) the alignment bars mentioned in step (a) are parallel to the axis which is parallel to the axis of rotation of the dry offset printing machine.

3. A process as recited in claim 2 wherein:

(a) two of the alignment bars are spaced from each other on a first line and (b) two of the alignment bars are spaced from each other on a second line, spaced from the first line.

4. A process as recited in claim 3 wherein:

(a) the outer ends of one alignment bar on each of the first and second lines lie on a third line which is perpendicular to the axis which is parallel to the axis of rotation of the dry offset printing machine and (b) the outer ends of the other alignment bar on each of the first and second lines lie on a fourth line which is perpendicular to the axis which is parallel to the axis of rotation of the dry offset printing machine and which is spaced from the third line.

5. A process as recited in claim 3 and further comprising the step of forming a first adjustment scale on the master template, the first adjustment scale projecting perpendicularly from the first line.

6. A process as recited in claim 5 and further comprising the steps of:

(a) forming a second adjustment scale on the master template, the second adjustment scale being perpendicular to the first and second lines, having an origin located between the first and second lines, and extending in both directions from its origin, and (b) forming an adjustment scale on each of the secondary templates which corresponds to the second adjustment scale on the master template, the origin of each of the adjustment scales on each of the secondary templates being located on the secondary template at a point corresponding to the origin of the second adjustment scale on the master template.

* * * * *